US007302956B2

(12) United States Patent
Cerruti et al.

(10) Patent No.: US 7,302,956 B2
(45) Date of Patent: Dec. 4, 2007

(54) WASHING AGENTS DISPENSER DEVICE FOR A DISHWASHING MACHINE

(75) Inventors: Daniele Cerruti, Fontanetto (IT); Stefano Belfiore, Borgo San Martino (IT); Costanzo Gadini, Casale Monferrato (IT)

(73) Assignee: Eltek, S.p.A., Casale Monferrato (IT)

( * ) Notice: Subject to any disclaimer, the term of this patent is extended or adjusted under 35 U.S.C. 154(b) by 662 days.

(21) Appl. No.: 10/469,339

(22) PCT Filed: Mar. 1, 2002

(86) PCT No.: PCT/IB02/00617

§ 371 (c)(1),
(2), (4) Date: Oct. 9, 2003

(87) PCT Pub. No.: WO02/069779

PCT Pub. Date: Sep. 12, 2002

(65) Prior Publication Data

US 2004/0069325 A1 Apr. 15, 2004

(30) Foreign Application Priority Data

Mar. 2, 2001 (IT) ..... TO2001A0190

(51) Int. Cl.
*B08B 3/00* (2006.01)
*A47L 15/00* (2006.01)

(52) U.S. Cl. ..... 134/56 D; 134/57 D; 134/58 D; 134/93; 134/114; 134/117; 134/186; 134/189; 134/190; 222/129; 222/160

(58) Field of Classification Search ..... 134/57 D, 134/56 D, 58 D, 93, 114, 117, 118, 186, 134/189, 190; 222/129, 160, 504
See application file for complete search history.

(56) References Cited

U.S. PATENT DOCUMENTS 5,884,821 A * 3/1999 Wilhelmstaetter et al. .. 222/511
2003/0188768 A1* 10/2003 Cerruti et al. ..... 134/57 D

FOREIGN PATENT DOCUMENTS

DE 19843976 A1 * 4/1999
WO WO 0197674 A2 * 12/2001

* cited by examiner

*Primary Examiner*—Alexander Markoff
(74) *Attorney, Agent, or Firm*—Levine & Mandelbaum

(57) ABSTRACT

Dispensing device of washing agents for a dishwashing machine, of the type comprises a body (2) to be fastened to a surface or wall delimiting a washing tub, having at least a portion of said body (2) protruding inside the washing tub; said dispenser (1) has at least a tank (11) for containing a liquid washing agent, means for dosing and/or dispensing a dose of liquid washing agent, a filling port (10) through which the liquid washing agent can be introduced into the tank (11), and closing means (15) of the filling port (10).

According to the invention, the closing means (15) are capable of at least two different operating positions, where in one position they are apt to receive the liquid washing agent and direct it or convey it to the filling port (10), in order to fill the tank (11).

42 Claims, 9 Drawing Sheets

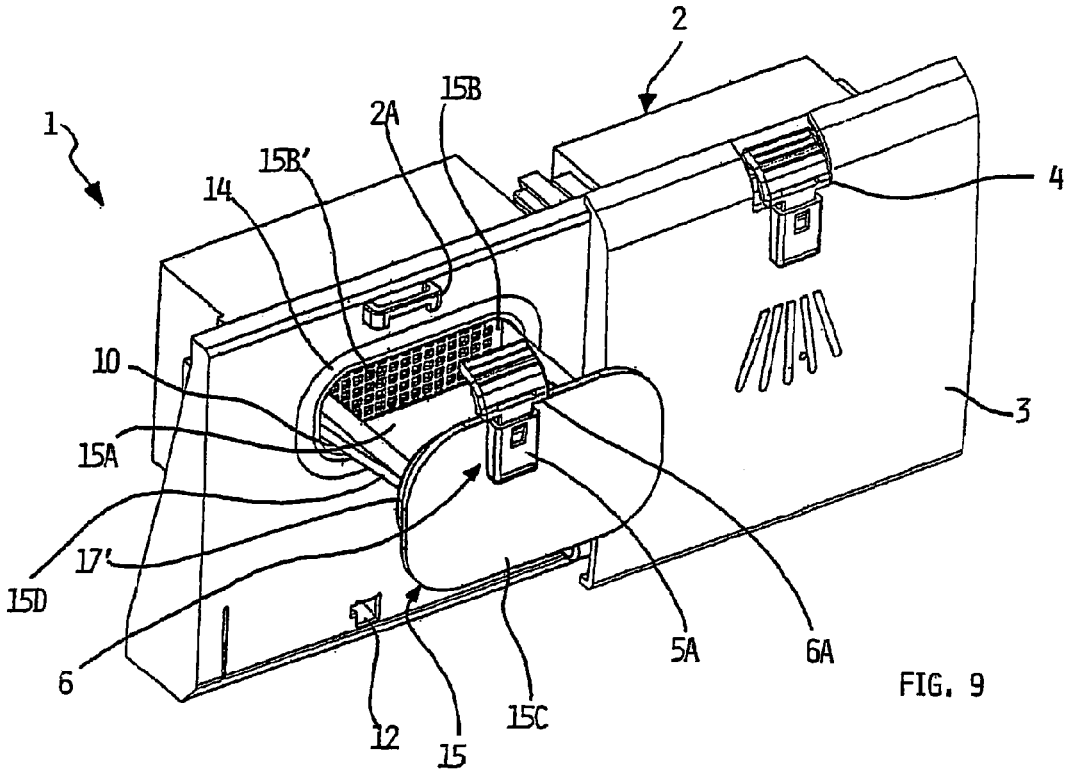
FIG. 9
FIG. 8
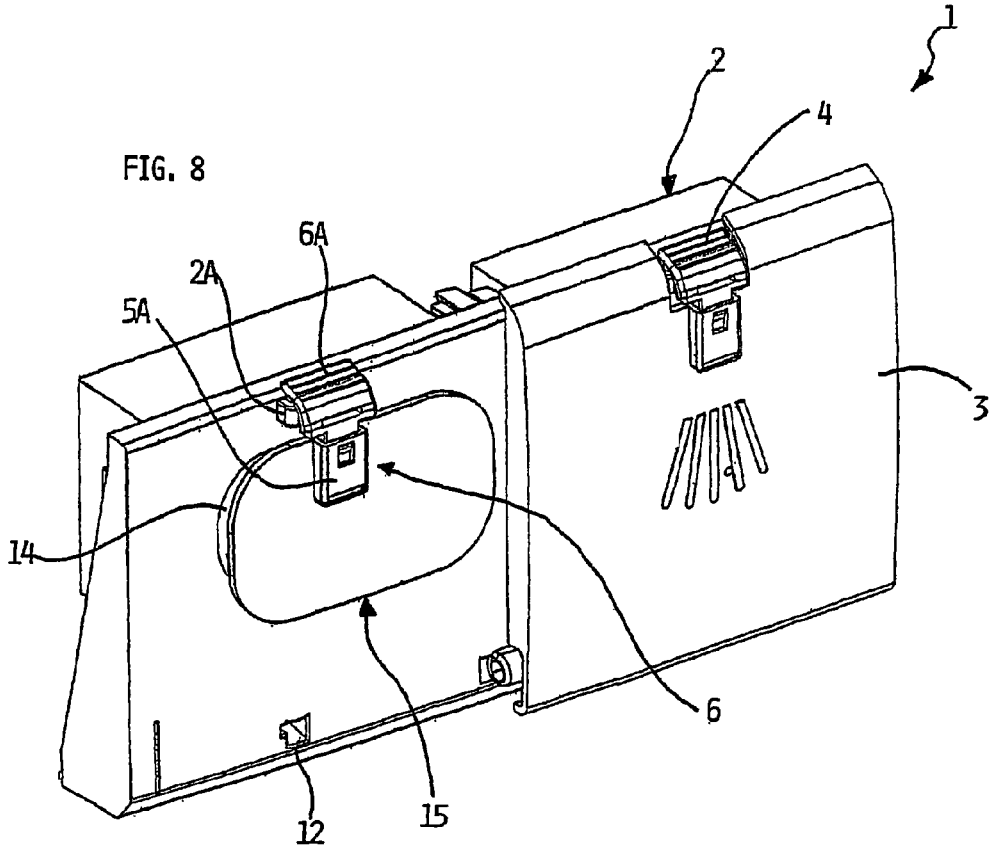

FIG. 13
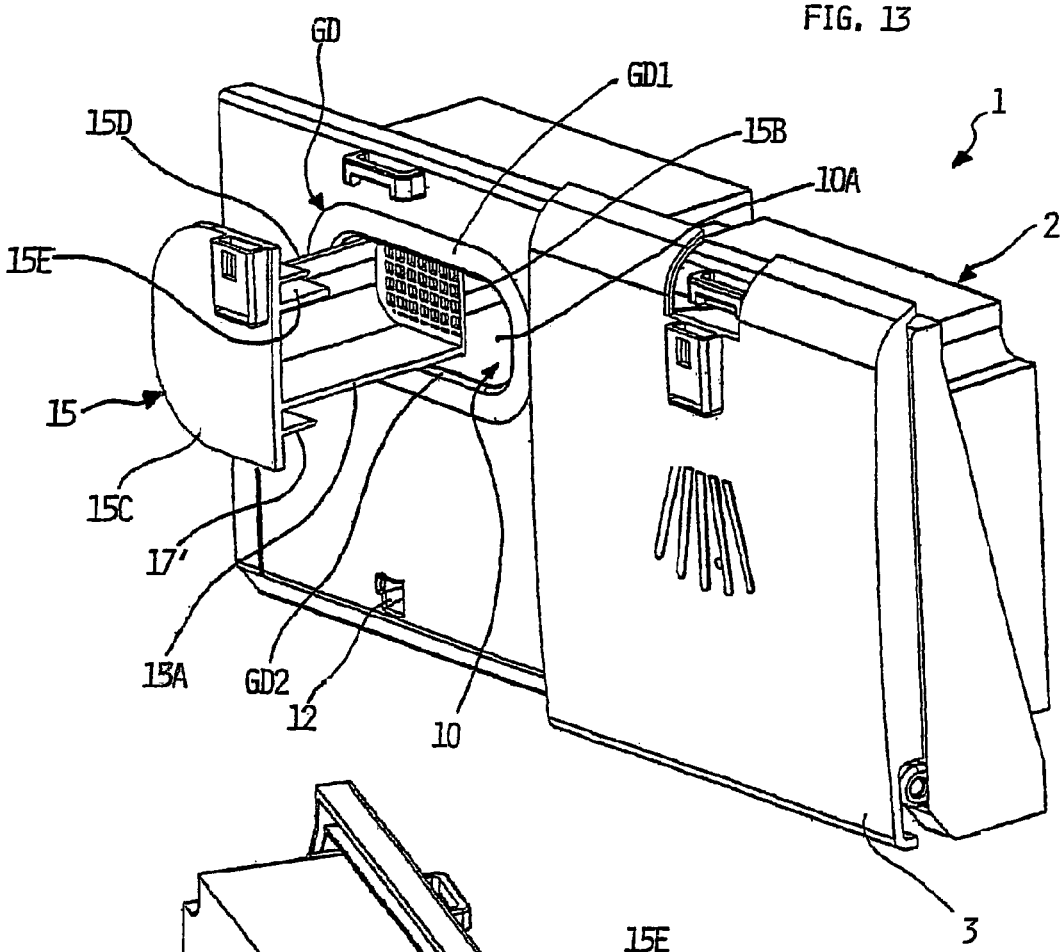
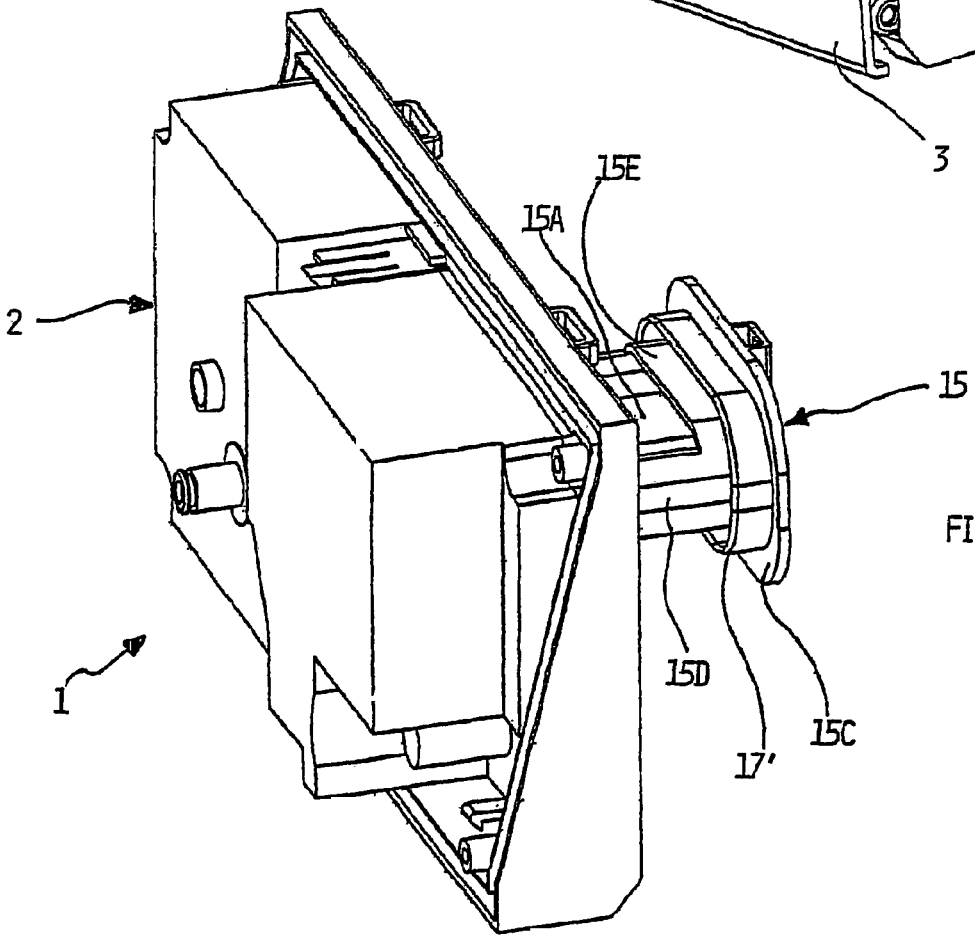
FIG. 14

WASHING AGENTS DISPENSER DEVICE FOR A DISHWASHING MACHINE

BACKGROUND OF THE INVENTION

The present invention relates to a dispensing device of washing agents for a dishwashing machine.

As known, washing machines are usually fitted with a dispensing device of washing agents, namely powder and/or liquid detergents and additives; typically, the latter consist of softening media for laundry washing machines and rinse aids for dishwashing machines.

In the instance of a dishwasher, the washing agents dispenser usually comprises a body made from plastic material, partially built-in in one of the vertical surfaces delimiting the washing tub of the machine; in most cases, this vertical wall is the dishwasher inner door, i.e. the side of the machine front loading door facing inside the washing tub.

In its front area, the above body delimits a compartment with a closing cover for containing a certain amount of solid washing agent, usually powder or in the form of a tablet, as required for executing a wash cycle.

A tank is also provided inside the dispenser body for containing a second liquid washing agent, typically a rinse aid; in general, this tank has the capacity for containing a sufficient amount of liquid agent to execute several wash cycles; thus, the machine user has only to fill the tank periodically, through a proper hole with a closing plug.

A small chamber inside the dispenser is associated to the above tank for dosing the amount of rinse aid to be dispensed during a wash cycle; to this purpose, the dosing system of the rinse aid uses the opening-closing movement of the machine door, i.e. horizontal in its open position and vertical in its closed position, for filling some of the rinse aid from the tank to the dosing chamber; during machine operation, a programmer or timer operates an actuator to release a discharge outlet in line with the dosing chamber, and let the dose of rinse aid flow from the latter into the washing tub of the dishwasher.

According to the technique previously known, the dispenser is assumed to be fastened to the dishwasher door, in order to utilize its opening-closing movement for dosing the rinse aid required for a wash cycle; this is the reason why application of these dispensers is actually restricted to washing machines with a tilting door around a horizontal axis.

Moreover, due to the above reasons the dispenser is normally designed to have both the opening of the compartment containing the washing agent and the plug of the rinse-aid tank directed upwards, when the machine door is open. Thus, after the door has reached its horizontal position, the user can fill the above compartment with the washing agent, close its cover and fill the rinse-aid in the relevant tank through the proper plug, if required; after these operations the user can close the machine door again and start the wash cycle.

The technique previously known requires filling of the washing agent and rinse aid with the machine door open, i.e. in a rather uncomfortable position for the user.

Some known washing machines are not fitted with a tilting loading door, but the latter is sliding linearly on appropriate guides; specifically for a twin-basket dishwashing machine, reference can be made to the solution described in FR-A-2.674.426; vice-versa, in other known solutions, the dishwasher has only one basket designed like a sliding drawer for containing the crockery to be washed, where the front wall actually represents the machine door.

Also in these machines the washing agents dispenser is either fastened to the machine door or anyway to a wall or vertical surface delimiting the washing tub; as a result, the dispenser is always laying on the same resting plane, independently from the door open-closed condition.

The dispensers applied to these machines usually have a housing seat for a container open upwards, which is partially tilting and hinged to the lower end. This container can be partially extracted from its seat when inclining it outside the dispenser body, so as to fill it with the dose of solid washing agent; a reverse movement of the container will bring it back to its housing seat delimited in the dispenser body.

As regards the liquid washing agent, the dispenser body can be fitted in its upper section with a plug for closing a duct in communication with the rinse-aid tank; in alternative, the plug seat can be appropriately shaped for filling the rinse-aid from above even if departing from the front surface of the dispenser.

However, also these solutions are uncomfortable for the user; substantially, this is due to the need of having minimized overall dimensions of the dispenser, so that the dispenser body section protruding towards the washing tub will not detract space to the housing of the baskets containing the crockery or to the crockery itself; as a result, the filling port of the rinse-aid and its relevant plug have very small dimensions, making it uncomfortable and difficult for the user to add rinse-aid to the tank.

SUMMARY OF THE INVENTION

It is the object of the present invention to solve the above drawbacks and provide a dispensing device of washing agents for a dishwashing machine, which can be easily operated by the user, is easy to manufacture, has a reliable operation and low cost.

In this general frame, a first aim of the present invention is to provide such a device, wherein filling of the liquid washing agent can be performed in a comfortable easy position for the user, in particular when the device is fastened on sliding doors or surfaces constantly vertical.

Another aim of the present invention is to provide such a dispenser, which has a minimum number of components of elementary manufacture.

Another aim of the present invention is to provide such a dispenser, which uses simple but highly reliable sealing means.

A further aim of the present invention is to provide such a dispenser, which can be assembled either on tilting doors or sliding doors or surfaces constantly vertical.

According to the present invention, one or more of these aims are attained by means of a dispensing device of washing agents for a dishwashing machine incorporating the features of the annexed claims, which form an integral part of the description herein.

DESCRIPTION OF THE DRAWINGS

Further aims, features and advantages of the present invention will become apparent from the following detailed description and annexed drawings, which are supplied by way of non limiting example, wherein:

FIGS. 8 and 9 show perspective views of the front part of a washing agents dispenser, according to a possible embodiment of the present invention, in two different operating conditions;

FIG. 13 shows a partial exploded perspective view of the front part of the washing agents dispenser according to the embodiment of FIG. 12;

FIG. 14 shows a perspective view of the rear side of the dispenser of washing agents according to the embodiment of FIG. 12.

DESCRIPTION OF THE PREFERRED EMBODIMENT

Figure 1:
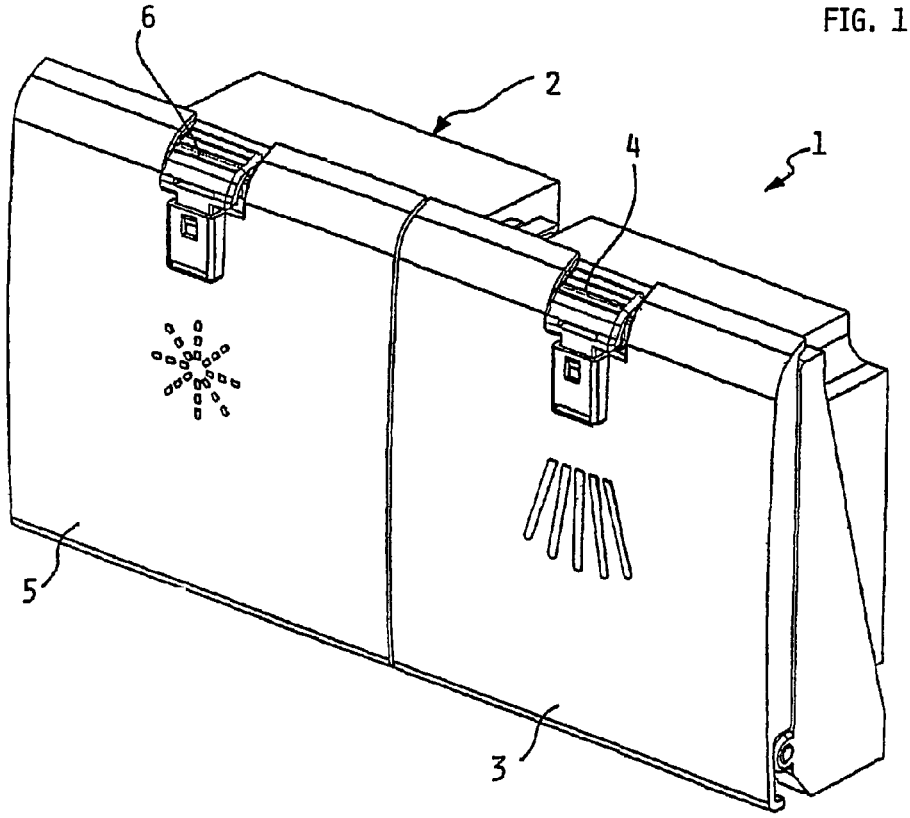
FIG. 1 shows a perspective view of the front side of a washing agents dispenser, according to the present invention.

In FIG. 1 reference 1 indicates a washing agents dispenser as a whole, realized according to the teachings of the present invention, provided for use on a dishwashing machine.

The dispenser 1 has a main body 2, at least partially housed in an opening provided in a wall of the machine washing tub, in particular in the inner door of the machine door; however, it should be noticed how the body 2 can be generally fastened to any vertical surface delimiting the above washing tub.

According to common art, the body 2 of the dispenser 1 is obtained by welding a front piece and a rear piece from thermoplastic material together, such as described in EP-A-1 059 058, whose teachings in this connection are incorporated herein for reference.

The body 2 has a compartment for containing a specific dose of washing agent, either a powder or in the form of a tablet or still as a liquid, as well as a tank for containing a certain amount of liquid washing agent, hereafter assumed to be a rinse-aid; the above compartment and tank are not directly visible in FIG. 1.

Always in FIG. 1, reference 3 indicates a first tilting cover for closing the above compartment of the washing agent, which cover is commonly hinged in its lower section to the body 2; reference 4 indicates a common hooking system for the cover 3, whose purpose is to keep the latter closed over the relevant compartment of the washing agent.

Reference 5 indicates a second angular movable cover, which covers the closing means of a filling port in communication with the above tank for introducing the rinse aid in the latter; reference 6 indicates schematically a hooking system for the cover 5 alike the previous one indicated with 4.

Figure 2:
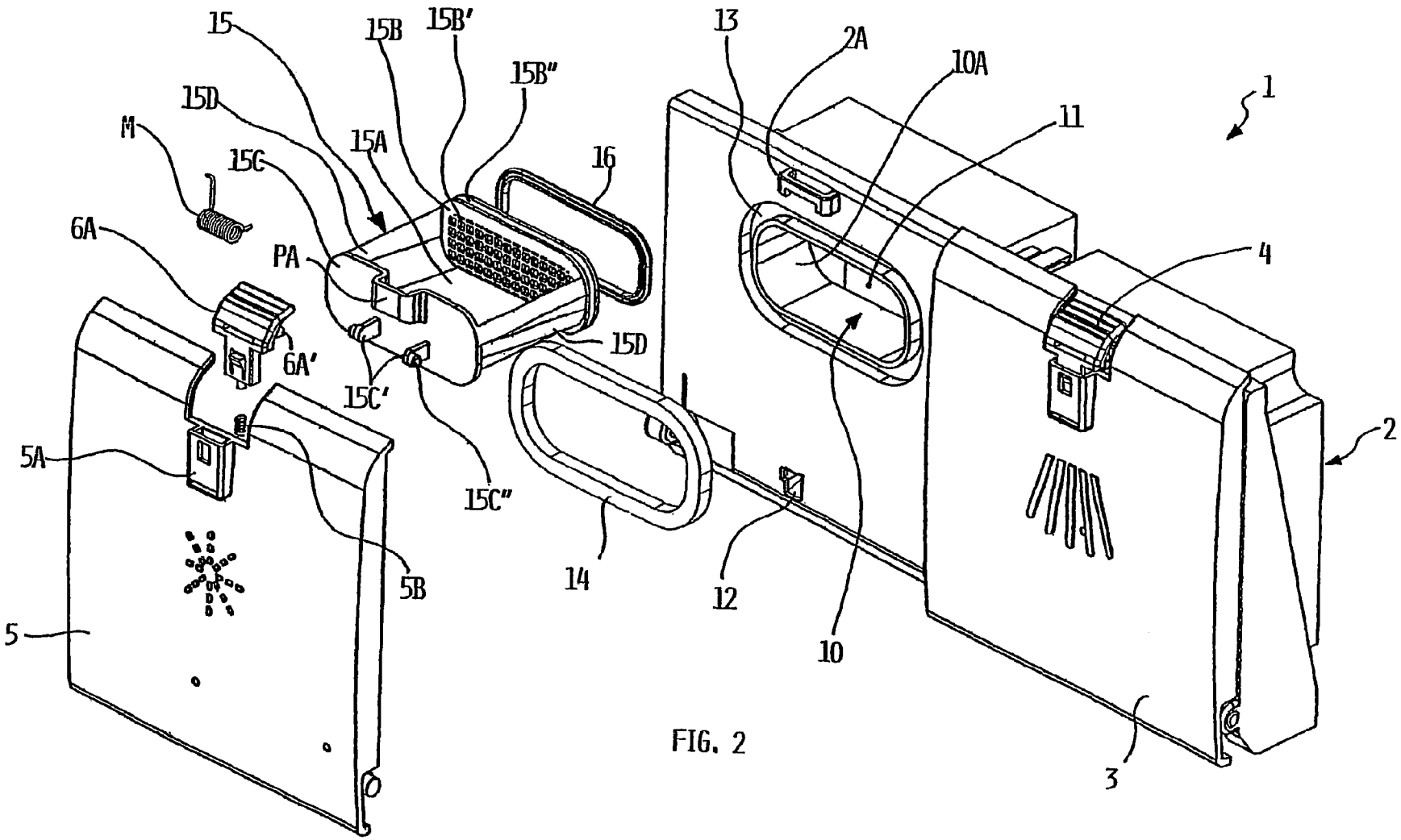
FIG. 2 shows a partial exploded view of the washing agents dispenser, according to the present invention.
Figure 5:
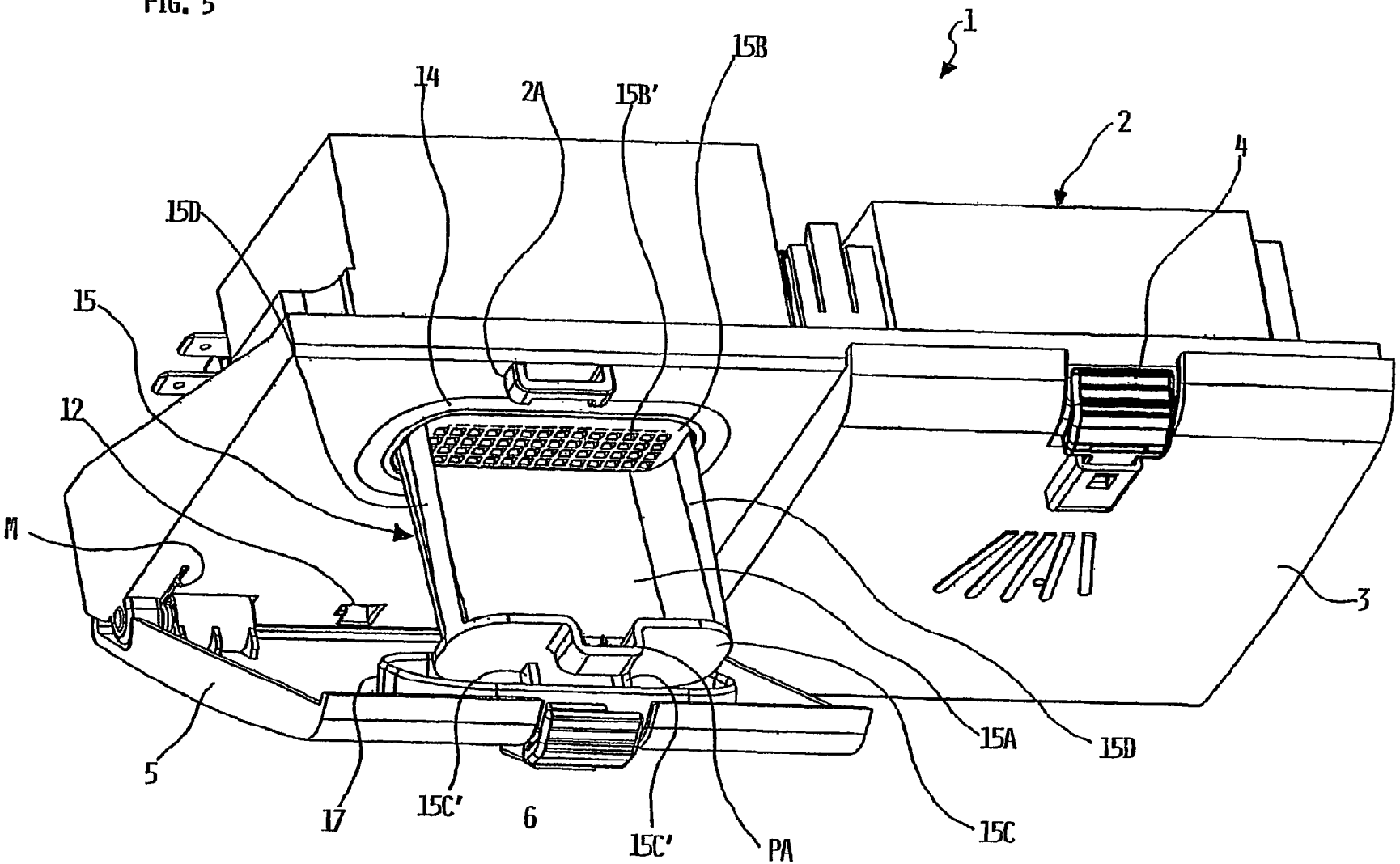

It should be noticed that in the preferred embodiment of the invention, at least the hinging system of the cover 5 to the body 2 comprises an elastic element, such as a spring M shown in the FIGS. 2 and 5, which causes an automatic opening movement of the cover when the latter is released by the system 6.

It should also be noticed that since the means for dispensing the washing agent and dosing/dispensing the rinse aid are apart from the scopes of the present invention, they will not be described herein; in main line, anyway, said means and relevant operations can be obtained through any known technique.

In FIG. 2, the dispenser object of the present invention is represented by a partial exploded view related to the part of interest herein, i.e. the one related to the filling system of the rinse aid in the relevant tank and/or closing system of the tank at the end of such a filling.

Reference 10 indicates the above filling port communicating with the rinse aid tank, indicated schematically with 11.

As it can be seen in FIG. 2, the filling port 10 does not consist of a simple hole in the front wall of the body 2, but it comprises a sort of tubular duct extending inside the tank 11; this duct is indicated in the figures with 10A.

Reference 12 indicates a discharge outlet through which a dose of rinse aid can be conveyed to the washing tub of the dishwasher according to common procedures.

Reference 13 indicates a seat surrounding the mouthpiece of the filling port 10, which is provided for housing a suitable sealing element, such as a ring gasket indicated with 14 in FIG. 2.

Reference 15 indicates a drawer element in its whole; as it will be further seen, this element is representing the above closing means of the port 10, besides favoring the rinse aid filling in the port 10.

In the example herein the drawer element 15 is substantially formed by a lower or bottom wall 15A, a rear wall 15B, a front wall 15C, two side walls 15D.

The bottom wall 15A is inclined from top to bottom starting from the front wall 15C towards the rear wall 15B (see FIGS. 6 and 7), to favor the liquid washing agent or rinse aid flowing inside the tank 11.

The rear wall 15B has a plurality of through-holes with a smaller section, indicated with 15B'; a seat 15B" delimited along the perimeter or outer edge of the wall 15B is apt to receive a suitable sealing element, such as a gasket indicated with 16 in FIG. 2.

Two extensions 15C' are delimited on the front surface of the front wall 15C, each one of them having a relief or pin 15C"; the front wall 15C also has a protruding portion PA, designed like a lead, being apt to obtain a sort of recess or step, whose functions will be further described.

As it can be seen in FIG. 2, the filling port 10 is not just a simple hole in the front wall of the body 2, but it comprises a sort of tubular duct extending inside the tank 11; in the figures this duct is indicated with 10A.

In FIG. 2 is also showing a possible implementation of the hooking system 6 of the cover 5; this system comprises a hooking element 6A to be snapped in a suitable seat 5A delimited in the cover 5, wherein an elastic element, such as a spring 5B has been previously housed; the element 6A comprises a rear tooth 6A' (see also FIG. 3), cooperating with a relevant seat 2A delimited on the front surface of the body 2.

As it can be guessed from the above example, the hooking system 6 has a manual actuation; the cover 5 is maintained in its closed position by the tooth 6A', which is engaged in the seat 2A to this purpose by the upwards action of the spring 5B (the latter pushing the hooking element 6A and then the tooth 6A'); the user wanting to open the cover 5 will simply press down the hooking element 6A to overcome the force of the spring 5B and cause the tooth 6A' to be released from the seat 2A.

Figure 4:
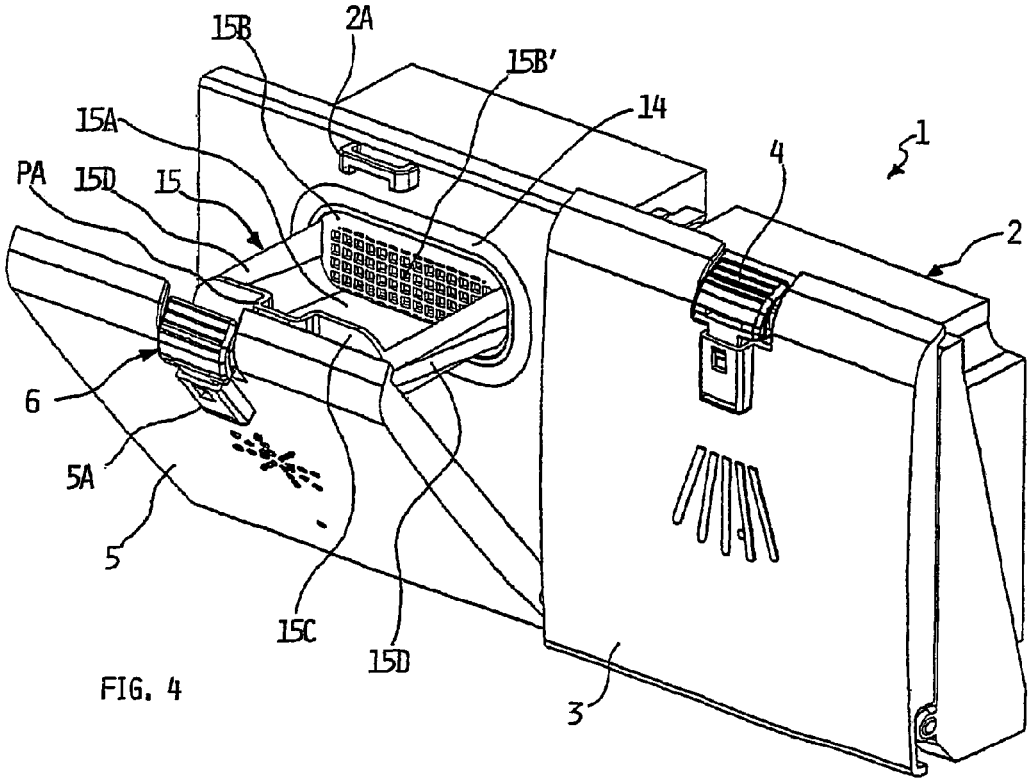
FIGS. 3, 4 and 5 show perspective views from different angle shots of the washing agents dispenser according to the present invention, in its filling position of a liquid washing agent.
Figure 3:
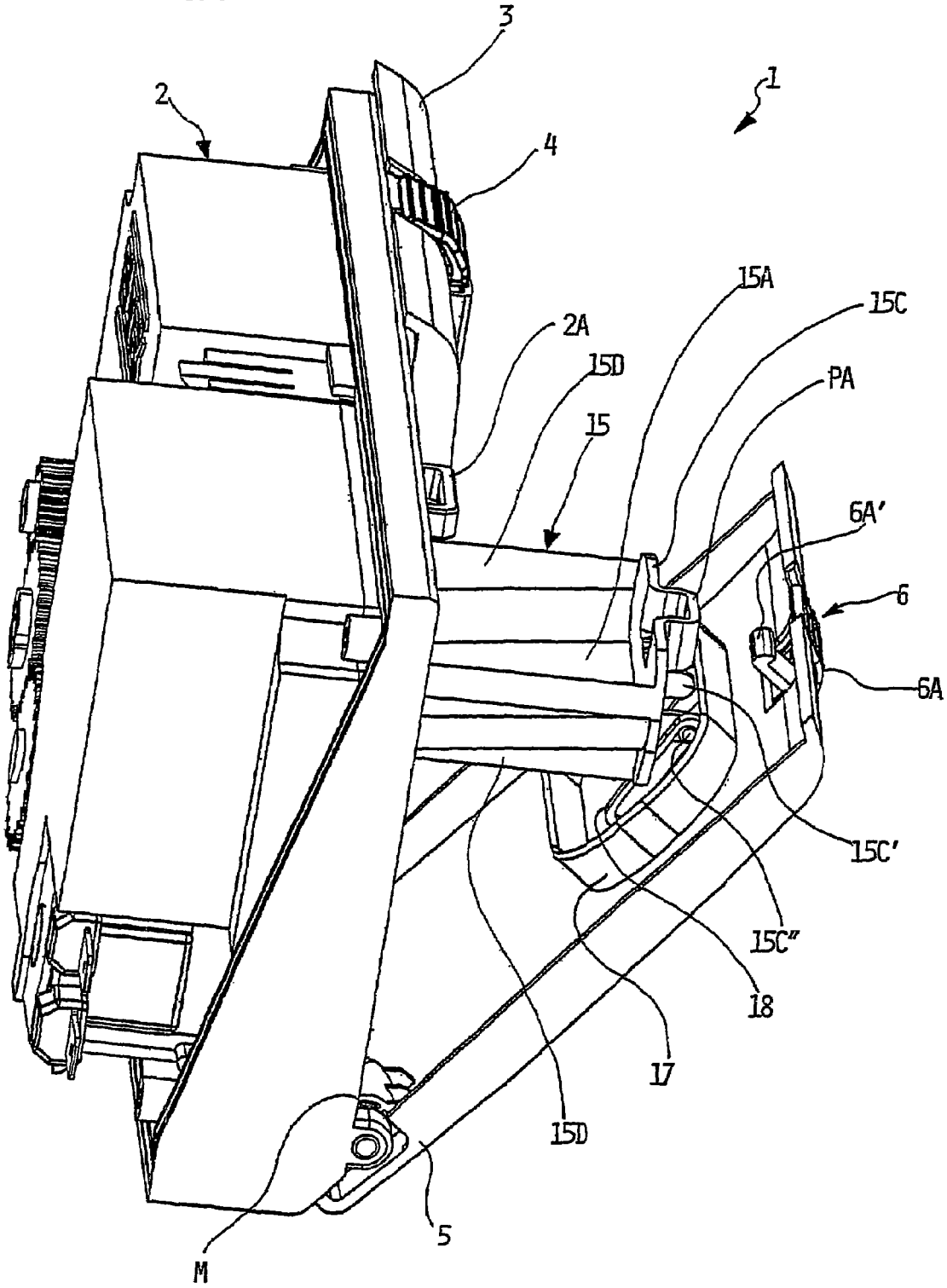

In the FIGS. 3, 4 and 5 the dispensing device 1 according to the invention is represented by various perspective views with the cover 5 in its open condition.

FIG. 3, in particular, is showing the rear side of the cover 5, wherefrom departs an overhanging edge or seat 17 with a tubular section; the free edge of this seat 17 has a form and dimensions substantially similar to those of the gasket 14 of FIG. 2 for the scopes to be further described.

Inside the seat 17 two parallel guides are also delimited, one of them indicated with 18, which are provided for receiving the pins 15C" of the extensions 15C' departing frontally from the wall 15C of the drawer element 15.

Thus, the drawer element 15 is constrained to the cover 5, where the mutual coupling obtained by the guides 18 and pins 15C" allows a certain extent of relevant movement between the parts.

Assembly of the device 1, as far as the filling system of the rinse aid previously described is concerned, is very simple.

The drawer element 15 fitted with the gasket 16, is inserted to the end in the duct 10A; then the gasket 14 will be inserted in the relevant seat 13.

Thereafter, the cover 5 eventually fitted with the hooking system 6, is hinged to the body 2 of the dispenser utilizing common means (including the spring M) and procedures.

Finally, by virtue of a certain elasticity proper of the thermoplastic material of the drawer element 15, the extensions 15C of the latter are slightly folded facing each other ensuring insertion of the pins 15C" in the respective seats 18 on the rear surface of the cover 5; since the extensions 15C recover their initial position elastically at the end of this operation, the pins 15C" will be engaged in the seats 18.

Obviously, the assembly described above should be merely regarded by way of example, since the assembly sequence of the various components may change according to the various requirements.

Operation of the device 1 according to the invention is now described with reference to the FIGS. 6 and 7, which illustrate schematically two section views of the dispenser 1 in two different operating conditions, i.e. in its rest position and rinse aid filling position.

The dispenser according to the present invention is assumed to be fastened on the surface of a sliding door (i.e. constantly vertical) facing inside the washing tub of a dishwasher; it is further assumed that the user of the dishwasher has to fill the tank 11 with rinse aid and the cover 5 is closed.

Figure 6:
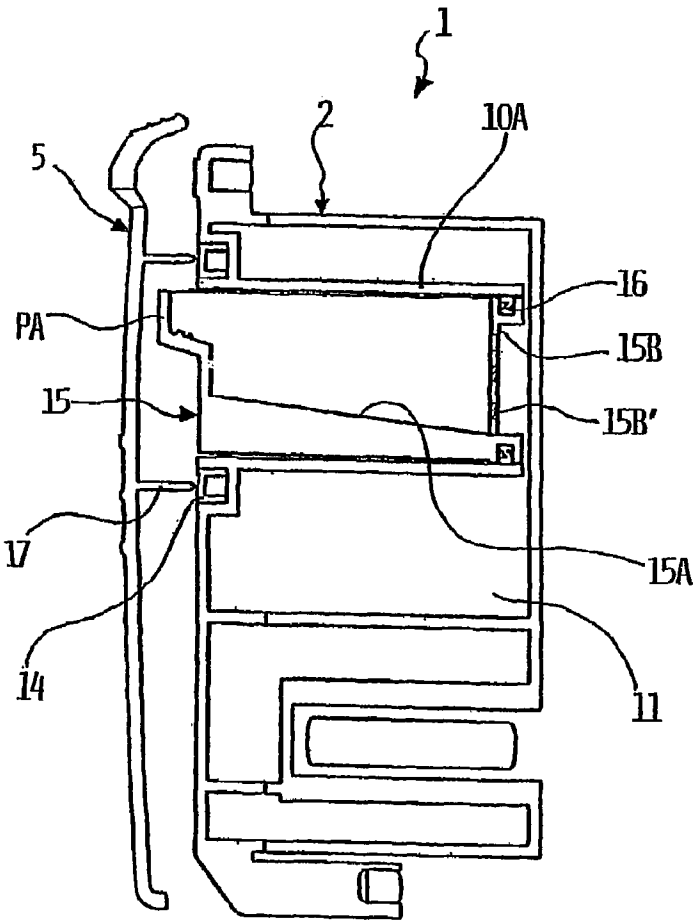

In this condition, as illustrated in the FIGS. 1 and 6, the edge of the seat 17 delimited on the rear surface of the cover 5 is pressed on the sealing gasket 14; moreover, in this condition, the pins 15C" of the extensions 15C' departing from the front wall 15C of the drawer element 15 are located on the lower end of the relevant guides 18, also delimited on the rear surface of the cover 5.

The drawer element 15 is further inserted to the end in the duct 10A, where the gasket 16 is sealing the surface of the latter and the edge of the seat 17 is pressed on the gasket 14 surrounding the filling port 10 due to the action of the spring M.

With the door of the dishwasher open, the user can load the crockery to be washed in the washing tub of the machine and fill the compartment of the dispenser 1 with the dose of powder detergent by means of the cover 3 according to common procedures.

In order to fill the rinse aid, the user has to release the cover 5 by means of the hooking system 6; thus, the spring M integrated in the hinging system of the cover 5 will cause an angular movement for the automatic opening of the latter.

Since the drawer element 15 is constrained to the cover 5 by the seats 18 and pins 15C", the angular movement of the cover 5 causes a stress on the drawer element 15 in the sense of pulling it out from the filling port 10. During the movement of the drawer element 15, the gasket 16 will slide over the surface of the tubular duct 10A and operate constantly as a seal with respect to it.

The pins 15C", originally located on the lower end of the guides 18 as mentioned above, can slide in the latter up to their upper end.

As described above, the drawer element 15 goes over from its rest condition of FIGS. 1 and 6 to its filling condition shown in the FIGS. 3-5 and 7.

In this condition, the user can pour the rinse aid in the recess delimited by the walls of the drawer element 15; as it can be guessed, this operation can be easily performed by the user in view of the dimensions of the drawer element 15 and of its wide central recess turned upwards.

Therefore, the rinse aid introduced in this recess can flow to the rear wall 15B of the recess of the drawer element 15, also due to the inclination of its bottom wall 15A; thus, the rinse aid will flow through the holes 15B', actually forming a filter, and then inside the duct 10A and the tank 11; it should be noticed how this liquid washing agent cannot flow back from the duct 10A to outside the body 2 due to the gasket 16 constantly sealing the duct 10A.

During the rinse aid intake, the filling level of the tank 11 up to a maximum level can be controlled for instance by the user by means of a common transparent signaling indication, not represented in the figures.

An advantageous embodiment of the present invention provides for indication of the maximum filling level of the tank 11 by means of the protruding portion PA of the drawer element 15; in particular, when the filling of the tank 11 approaches its full level, the rinse aid will cease to flow through the holes 15B" and gradually fill the recess of the drawer element 15: the filling condition of the tank 11 is indicated by the rinse-aid level reaching the lower point of the protruding portion PA in the drawer element 15 (preferably, the maximum filling amount reported by the above indication or signaled by the portion PA will anyway be lower than the real capacity of the tank 11).

Apart from the indication of maximum filling as for the above example, it is underlined, anyway, how according to the invention, the level of the rinse aid filled in the tank 11 can exceed the lower edge of the filling port 10, without an overflowing problem of the rinse aid outside it. This is obtained through the gasket 16 constantly sealing the duct 10A, independently from the position of the drawer element 15.

Once the required amount of rinse aid has been introduced in the tank 11, the user will simply close the cover 5, imparting just an angular movement to it for the hooking system 6 to operate.

This angular movement will impart a thrust to the drawer element 15, which is going to slide inside the duct 10A, with the gasket 16 constantly operating on the duct surface, i.e. hindering a possible rinse aid outflow from the tank 11.

Figure 7:
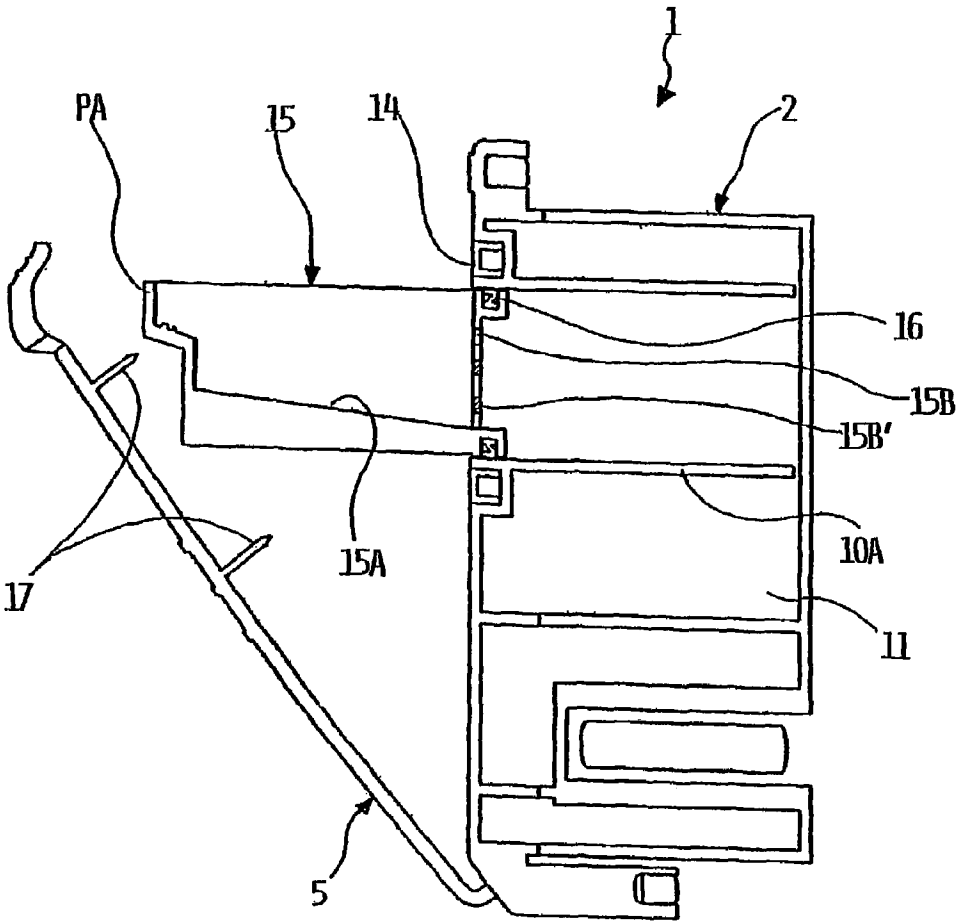
FIGS. 6 and 7 show schematic sections of the washing agents dispenser according to the present invention, in two different operating conditions.

By means of the same movement, the pin 15C", located at the upper end of the guides 18 in the condition of FIG. 7, can slide downwards in the guides to their lower end.

When the cover 5 has reached its closed position and the drawer element 15 is completely inserted again in the duct 10A, the seat edge 17 will also be resting on the gasket 14 surrounding the filling port 10, with the seat 17 pressing the gasket 14 due to the spring action M. Thus, the situation is back to the starting condition of FIG. 6.

Now, the user can close the door of the dishwasher and start the wash cycle as usually known.

It should be noticed how during washing, a water leakage towards the drawer element 15 is hindered by the presence of the seat 17 and gasket 14; the gasket 14, along with the gasket 16 forms a double sealing system against possible rinse-aid leakages from the filling port 10 inside the washing tub of the machine.

During the wash cycle, according to common procedures, the control system will provide in due time for dispensing the washing agent and rinse aid, which are apart from the scopes of the present invention, as mentioned above.

From the above description it is clear how the rinse-aid filling system is extremely simple and particularly its use very comfortable for the user.

Also manufacture of the above filling system is extremely simple and cost effective. The filling port 10, the duct 10A and the seat 13, in fact, can be directly obtained during the molding of the front piece of the body 2; the same applies for the seat 17 and guides 18, which can be directly obtained during the molding operation of the cover 5.

Also the drawer element 15 can be obtained through elementary molding operations; on the other hand, the gaskets 14 and 16, and the parts of the hooking system 6 and hinging system of the cover 5 as well, consist of standardized components normally manufactured in large series, i.e. having a high reliability and low cost.

In the previous example the dispenser 1 according to the invention is assembled on a sliding door; however, in main terms it is clear that the dispenser may be assembled on any constantly vertical surface delimiting the washing tub of a machine; on the other hand it is also clear that the device 1 may also be assembled on machines with tilting doors; as regards the latter instance, it should be noticed how the device 1 according to the invention will considerably facilitate the filling operations of the rinse aid with half-open tilting doors, also with an inner door (i.e. the surface whereon the device 1 is assembled) inclined by 45° and more.

From the above description and the annexed claims forming an integral part of it, the features and advantages of the present invention are clear.

As seen above, the filling system of the dispenser 1 according to the invention comprises a drawer element or small tank 15, which slides horizontally in a suitable seat 10-10A of the body 2 of the dispenser; the preferred embodiment of the present invention has the drawer element 15 interacting with a cover 5 of the dispenser, being angularly movable, so that the movement of the latter will also cause the former to move.

The particular form of the drawer element 15 will facilitate the filling operation of the rinse aid in the relevant tank 11, which can also take place with the machine door being open or in vertical position.

The drawer element 15 is also fitted with suitable sealing means 16 on the duct 10A of the body 2, which ensure, on one hand, a high filling level of the tank 15, and prevent, on the other, outflow problems of the rinse aid, also when this level exceeds the lower limit of the port opening 10.

The dispenser can be assembled either on tilting doors, sliding doors or constantly vertical surfaces, and the liquid rinse-aid filling take place in a comfortable and easy way for the user.

The movements required for filling the dose of washing agent and its subsequent dispensing are operations of elementary type.

The sealing means provided, though of simple manufacture, warrant high reliability and prevent water leakages inside the rinse-aid tank and rinse-aid overflow outside; in spite of a front filling port, the filling level of the washing agent in the tank can be a high one.

Manufacture and assembly of the components of the liquid washing-agent filling system are simple, reliable and cost effective.

Obviously many changes are possible for the man skilled in the art to the washing agents dispenser for a washing machine, in particular a dishwasher, as previously described, and it is also clear that in practical actuation of the invention the various forms, size, proportions and materials employed may differ from the ones described above by way of example and be replaced by technical equivalent elements.

A first possible embodiment may provide specific mechanical stops to the extraction movement of the drawer element 15; these means may comprise for instance one or more radial protruding relieves from the rear wall 15B, interfering with the edge of the filling port 10 facing the duct 10A, when the drawer element 15 has reached its maximum extraction condition allowed; according to this embodiment, the filling port 10 will have a slightly smaller section compared to the duct 10A and during assembly the drawer element 15 will be inserted from the rear side of the duct 10A before welding the two pieces forming the body 2 of the device 1.

Another possible embodiment, the rear wall 15B of the drawer element 15 has one large port only instead of a plurality of holes 15B', in which case the wall would be designed like a frame with the housing seat 15B" of the gasket 16 delimited on its outer edge.

A further possible embodiment would have the gasket 14 and/or gasket 16 manufactured by co-molding or over-molding of a suitable elastic material on the body 2 and/or drawer element 15, respectively.

In addition or in alternative to the spring M of the hinging system of the cover 5, another elastic element may be provided, such as a spiral spring, operating directly on the drawer element 15, tending to automatically push the latter to its respective open/filling position when the cover 5 is released by means of the hooking system 6 (see for instance the embodiment of FIGS. 12-14); therefore in this embodiment, automatic opening of the cover 5 would be obtained simultaneously, also without the spring M.

With reference to the last implementation above, the drawer element 15 may also be equipped with a bi-stable hooking/release kinematics of its own, i.e. being apt to engage when closing as the drawer element 15 is pressed a first time inside the filling port 10, and being apt to release when opening as the drawer element 15 is pressed a second time inside the filling port 10 due to the reaction of an elastic element, such as a spiral spring, previously compressed during the closure of the drawer element 15 (i.e. following the first pressure).

According to this embodiment, wherein the bi-stable kinematics may be integrated e.g. in the same drawer element 15, the cover 5 could even be omitted or maintained anyway as an opening aid for the drawer element 15 in case of extreme frictions.

The above bi-stable kinematics can be represented by any device generally called push-push or push-to-open device (such as the solution described in U.S. Pat. No. 4,655,489), or based on the use of a closed circuit cam, such as described in EP-A- 0 602 572; in this event, the drawer element 15 could have a side metal stake capable of moving within the closed path delimited by the above cam, which would be associated to the body 2.

Since the drawer element 15 and the cover 5 are either constrained or mechanically connected to each other will ensure the automatic movement of the first one after the opening of the second one; however, it is clear that these two components may not be connected to each other, i.e. they are actuated independently, in which case to the drawer element 15 would preferably be associated to the above stop means.

FIGS. 8-11 illustrate a possible embodiment of the present invention, wherein the cover 5 of FIGS. 1-7 is omitted; it should be noticed how in the FIGS. 8-11 the same reference numbers of the previous figures are used to indicate technical equivalent elements.

According to the suggested embodiment, the front wall 15C of the drawer element 15 has larger dimensions compared to the embodiment of FIGS. 1-7, and an overhanging edge or seat 17' with a tubular section departs from its rear surface to perform the functions of the seat 17 of FIGS. 1-7; therefore, the form and dimensions of the free edge of the seat 17' are such to cooperate with the gasket 14 for sealing purposes.

Moreover, in this case the drawer element 15 has a hooking system quite similar to the one illustrated in the FIGS. 1-7, i.e. comprising a seat 5A delimited on the front surface of the wall 15C, wherein a hooking element 6A with a rear tooth 6A' (see FIG. 10) is inserted for cooperating with the relevant seat 2A delimited on the front surface of the body 2.

As it can be guessed, operation of the device 1 according to the embodiment illustrated in the FIGS. 8-11 is very similar to the one previously described.

Figure 11:
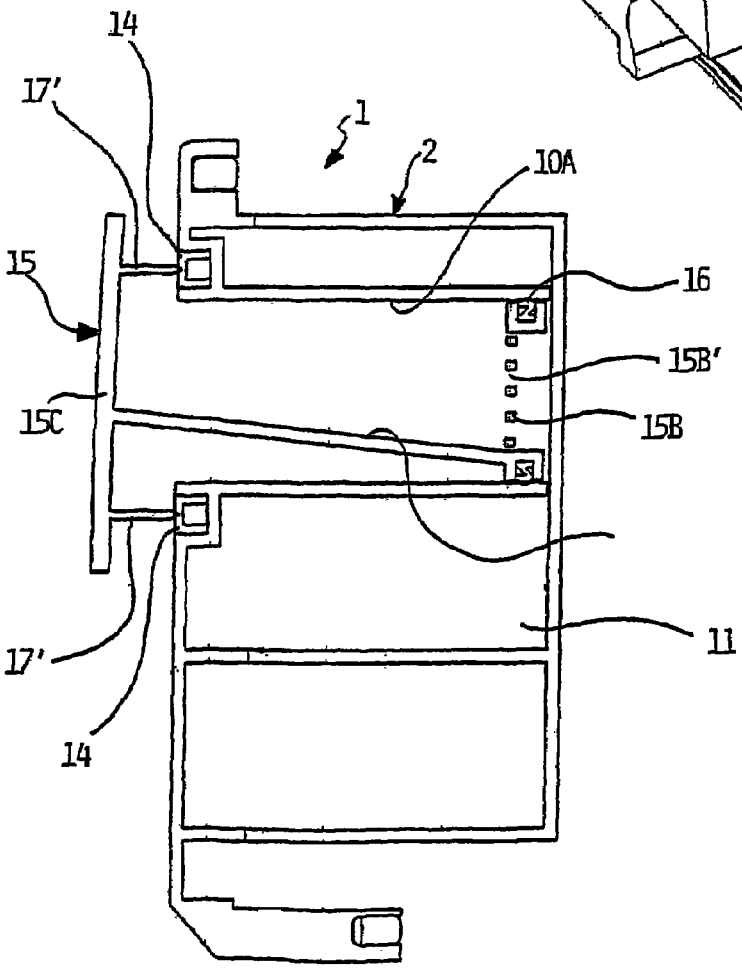
FIG. 11 shows schematically a section of the washing agents dispenser in the operating condition of FIG. 9.

In this closed condition of the drawer element 15, as illustrated in the FIGS. 8 and 11, the edge of the seat 17' delimited on the rear surface of the front wall 15C of the drawer element 15, is pressed on the sealing gasket 14.

In order to execute the rinse-aid filling, the user releases the drawer element 15 by means of the hooking system 6, and draws it towards outside of the body 2; during the movement of the drawer element 15, the gasket 16 will slide over the surface of the tubular duct 10 A constantly sealing it; it should be noticed that in the case a compression spring be provided to push the drawer element 15 out from inside the body 2, no traction would be required by the user after the hooking system 6 has been released; however, more force will be required for a subsequent closure of the drawer element 15 to compress the above spring.

Figure 10:
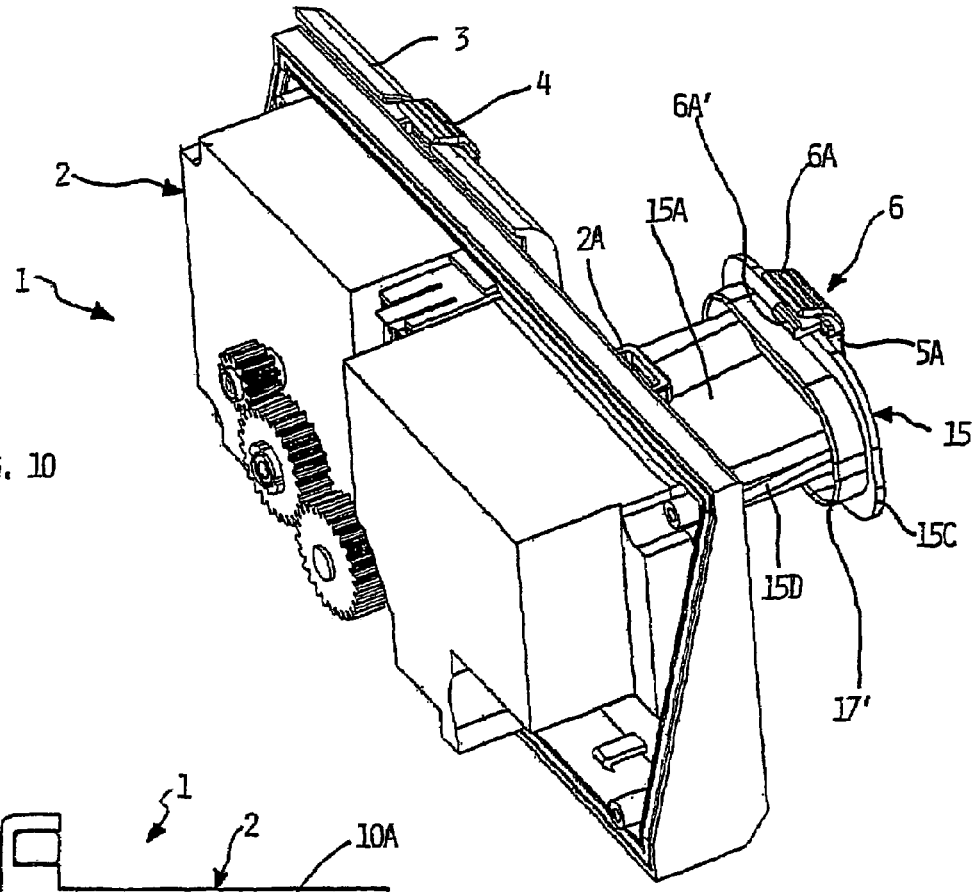
FIG. 10 shows a perspective view of the washing agents dispenser of FIG. 8, from a different angle shot with respect to that figure, in its filling condition of a liquid washing agent.

As described above, the drawer element 15 will go over from its rest condition of the FIGS. 8 and 11 to the filling condition of the FIGS. 9 and 10.

In this condition, the user can pour the rinse aid in the recess delimited by the walls of the drawer element 15 according to the procedures previously described.

Also in this instance, the level of the rinse aid filled in the tank 11 may exceed the lower edge of the relevant filling port 10, without any outflow problem of the rinse aid outside; this is ensured by the presence of the gasket 16 constantly sealing on the duct 10A, independently from the position of the drawer element 15.

Once the required amount of rinse aid has been filled in the tank 11, the user will close the drawer element 15 simply imparting a linear movement to it until the hooking system 6 is actuated.

This movement will cause the drawer element 15 to slide inside the duct 10A, with the gasket 16 constantly operating on the surface of the duct itself, i.e. without any rinse aid leakage from the tank 11.

The closed position being reached, i.e. the drawer element 15 completely inserted again in the duct 10A, also the edge of the seat 17' will rest on the gasket 14 surrounding the port opening 10 and the subsequent coupling of the hooking system 6 with the seat 2A cause the seat 17' to remain constantly pressed on the gasket 14. Therefore, the situation is back to the starting conditions of the FIGS. 8 and 11, so the user can close the dishwasher door and start the wash cycle in the usual way.

Also in this case, a water leakage to the drawer element 15 during washing is hindered by the seat 17' and gasket 14; the gasket 14 along with the gasket 16 will then form a double sealing system to prevent likely rinse-aid leakages from the filling port 10 inside the washing tub of the machine.

As it can be seen, according to the suggested embodiment the cover 5 of the FIGS. 1-7 can be removed for a more simplified manufacture and lower costs of the dispensing device according to the invention.

A further possible implementation, the sealing means consisting of the gasket 16 may be associated to the body 2 or duct 10A, and provided for constant operation on the drawer element 15.

In this embodiment, the sealing means may be located for instance in the initial path of the duct 10A and the drawer element 15 can comprise an upper wall with a rinse-aid filling port in an intermediate position near the front wall 15C; when the drawer element 15 is in its closed condition, the sealing means operate not only on the side and bottom walls of the drawer element, but also on the portion of the upper wall extending between said port and the front wall 15C, whereas with the drawer element 15 in its open condition, the sealing means operate not only on the side and bottom walls of the drawer element, but also on the portion of the upper wall extending towards the bottom wall 15B; going over from the open position of the drawer element to its closed position and vice-versa, the above port goes below a length of the sealing means; for this reason, the port edges should preferably have a flare facing inside the recess of the drawer element 15 to avoid wear and/or damages to the sealing means.

According to a further possible embodiment similar to the one described above, the sealing means previously indicated with 14 and 16 may be integrated as a single element.

Figure 12:
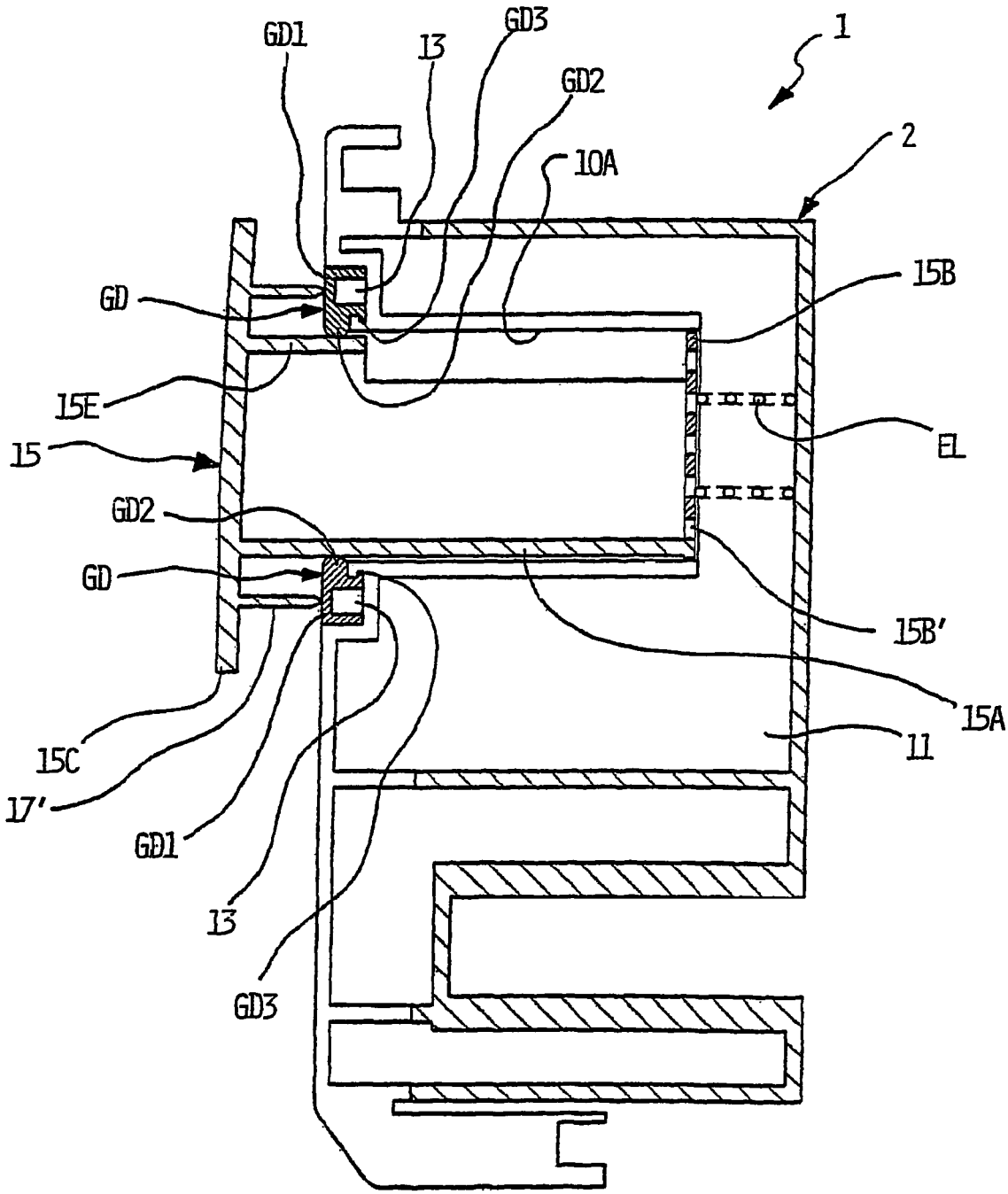
FIG. 12 shows schematically a section of a washing agents dispenser according to a further possible embodiment of the present invention.

This embodiment is illustrated in the FIGS. 12-14, where the same reference numbers of the previous figures indicate technical equivalent elements (in these figures some device elements according to the invention have been omitted, such as a few parts of the hooking system 6).

In this embodiment, the drawer element 15 has at least a length of the upper wall indicated with 15E in the FIGS. 12-14, departing from the front wall 15C; in this case, the sealing gasket inserted in the seat 13, now indicated with GD, has two portions performing different functions, in particular:

- a first outer portion GD1 for obtaining a resting or front seal on the seat 17' of the front wall 15C of the drawer element 15,
- a second inner portion facing the center of the filling port 10, for obtaining a radial seal on the drawer element 15.

Moreover, the gasket GD has preferably also a hooking extension indicated with GD3, which engages a cavity delimited inside the seat 13, hindering an undesired extraction of the gasket GD.

As it can be seen from FIG. 12, when the drawer element 15 is in its closed condition, the portion GD1 of the gasket GD operates as a front seal for the seat 17', whereas the portion GD2 operates as a radial seal for the outer surfaces of the bottom wall 15A and of the length of upper wall 15E, obviously besides the outer surfaces of the side walls 15D.

While the drawer element 15 goes over from its closed position to its open position, at a certain time the portion GD2 will cease its sealing action for the length of the upper wall 15E, so the rinse-aid filling compartment becomes accessible outside the opening 10; vice-versa, when the drawer element 15 is nearly at the end of its subsequent changeover from an open position to a closed position, the portion GD2 will be sealing again for the upper wall length 15E.

It should be noticed, anyway, that the portion GD2 of the element GD is always and anyway operating as a radial seal for the bottom walls 15A and side wall 15D of the drawer element 15, independently from the operating position of the latter.

FIG. 12 also illustrates an elastic element EL, such as a spiral spring, operating directly on the drawer element 15, as previously mentioned; in the above example, this spring EL located between the rear wall 15B of the drawer element and a wall of the tank 11, is provided to push the drawer element 15 automatically to its respective open/filling position, when the cover 5 is released by means of the relevant hooking system 6; obviously, in order to close the drawer element 15, the user shall push the latter inside the opening 10 and port 10A strongly enough to overcome the force of the spring EL.

Other possible implementations have the gaskets 14 and 16, or the element GD integrating them both, manufactured by over-molding or co-molding or upsetting process of an elastic material on the body 2.

The filling system of the device 1, in the various examples of the possible embodiments suggested above, has been described herein with reference to a rinse-aid, but it is clear that the invention is capable of application also in the instance of other washing agents, such as liquid detergents.

The invention claimed is:

1. A dispensing device for administering washing agents into a washing tub of a dishwashing machine comprising a housing including, a tank having a filling port for filling said tank with a liquid washing agent, and a doser operatively connected to said tank for dispensing a dose of said liquid washing agent into said tub, said device further comprising a closure for said filling port movably mounted on said housing for being linearly moved through said filling port, at least between a first operating position, wherein said closure seals said port, and a second operating position, wherein said closure extends beyond said filling port for receiving the liquid washing agent and conveying it to said filling port, in order to fill said tank.

2. A device according to claim 1, wherein said closure is mechanically coupled to said housing.

3. A device according to claim 1, wherein said closure comprises a first seal which engages a surface of said housing irrespective of the operating position of said closure.

4. A device according to claim 1, comprising a first seal disposed between said housing and said closure for preventing leakage of the liquid washing agent from said tank through said filling port irrespective of the operating position of said closure.

5. A device according to claim 1, comprising a first seal disposed between said housing and said closure, for preventing leakage of the liquid washing agent from said tank when the level of the liquid washing agent in the tank exceeds a lower edge of said filling port.

6. A device according to claim 4 wherein said closure comprises said first seal.

7. A device according to claim 1, further comprising a cover pivotally mounted on said housing for moving angularly from a closed position to an open position.

8. A device according to claim 7, comprising a connector attached to said closure and to said cover, said connector allowing relative movement between said closure and said cover.

9. A device according to claim 7, wherein in said closed position said cover covers said filling port, and in said open position said cover allows access to said closure.

10. A device according to claim 8, wherein during movement of said cover from said closed position to said open position said connector moves said closure from said first operating position to said second operating position, and during movement of said cover from said open position to said closed position said connector moves said closure from said second operating position to said first operating position.

11. A device according to claim 7, comprising a second seal disposed between said cover and said housing when said cover is in said closed position.

12. A device according to claim 1, comprising a second seal disposed between said closure and said housing when said closure is in said first operating position.

13. A device according to claim 11, wherein said second seal surrounds said filling port and is disposed in a seat within said housing.

14. A device according to claim 11, wherein said second seal engages a portion of said cover projecting from a surface of said cover facing said filling port and having a tubular section.

15. A device according to claim 12, wherein said second seal engages a portion of said closure projecting from a surface of said closure facing said filling port and having a tubular section.

16. A device according to claim 1, comprising a hinge operatively connected between said closure and said housing, said hinge comprising an elastic member for urging said closure from said first operating position to said second operating position.

17. A device according to claim 16, wherein said elastic member is operatively connected between said cover and said housing.

18. A device according to claim 16, wherein said elastic member is operatively connected to said closure.

19. A device according to claim 1, further comprising a duct extending between said filling port and said tank.

20. A device according to claim 18, wherein said closure is slideable within said duct.

21. A device according to claim 3, wherein said first seal is mounted on said closure and engages a portion of a surface of said duct.

22. A device according to claim 3, wherein said second seal is mounted on said housing for engagement with a portion of a surface of said closure.

23. A device according to claim 1, wherein said closure comprises a stop for limiting the movement of said closure from said filling port.

24. A device according to claim 1, wherein said filling port is located on a surface of said housing parallel to a wall of said tub.

25. A device according to claim 1, wherein said filling port is located in a front surface of said housing.

26. A device according to claim 1, wherein said closure is movable in a direction transverse to a front surface of said housing.

27. A device according to claim 1, wherein said closure comprises a drawer.

28. A device according to claim 11, wherein said first seal and said second seal are integrated into a single sealing element.

29. A device according to claim 28, wherein said single sealing element comprises one portion for engaging the front of said overhanging portion of said cover, and another portion for sealing a perimeter of said closure.

30. A device according to claim 28, wherein at least one of said first seal, said second seal, and said single sealing element is formed from an elastic material on said housing.

31. A device according to claim 1, wherein said closure comprises an inclined bottom wall.

32. A device according to claim 1, wherein said closure comprises a rear wall having a port through which the liquid washing agent can flow to said tank.

33. A device according to claim 32, wherein said wall has a plurality of ports small enough to filter at least some solid particles from the liquid washing agent.

34. A device according to claim 32, comprising a first seal mounted within a seat delimited along a perimeter of said rear wall.

35. A device according to claim 31, comprising a first seal mounted on said housing.

36. A device according to claim 35, wherein said closure comprises a wall engaged by said first seal when said closure is in said first operating position.

37. A device according to claim 8 wherein a portion of said connector is integral with said closure.

38. A device according to claim 8, wherein said connector comprises a guide mounted in said cover.

39. A device according to claim 1, wherein said housing is comprises a thermoplastic front piece and a thermoplastic rear piece welded to said thermoplastic front piece.

40. A device according to claim 1, comprising an indicator for signaling a maximum filling level of said tank mounted on one of said housing and said closure.

41. A device according to claim 40, wherein said indicator is disposed in said closure.

42. A dishwashing machine comprising a washing tub and a dispensing device for washing agents and having a housing fastened to a surface or wall delimiting said tub, wherein said dispensing device comprises a tank for containing a liquid washing agent, delimited in at least a portion of said housing, a doser for dispensing a dose of said liquid washing agent into said tub, a filling port in said housing, through which the liquid washing agent can be filled into said tank, and a closure for said filling port mounted on said housing, wherein said closure is linearly movable through said filling port, at least between a first operating position, wherein a portion of said closure at least partially disposed within said housing, and a second operating position, wherein said portion is located outside said housing, said closure, when in said second operating condition, directing received liquid washing agent to said filling port, in order to fill said tank.

* * * * *